US007552976B2

(12) United States Patent
Brown

(10) Patent No.: US 7,552,976 B2
(45) Date of Patent: Jun. 30, 2009

(54) AUTOMATED ROOFING MATERIAL REMOVAL MACHINE AND METHOD

(76) Inventor: Methuselah (Matt) I. Brown, N9738 Korb Rd., St. Cloud, WI (US) 53079

( * ) Notice: Subject to any disclaimer, the term of this patent is extended or adjusted under 35 U.S.C. 154(b) by 292 days.

(21) Appl. No.: 11/259,026

(22) Filed: Jan. 18, 2006

(65) Prior Publication Data

US 2007/0164597 A1 Jul. 19, 2007

(51) Int. Cl.
*E04D 15/02* (2006.01)

(52) U.S. Cl. ..... 299/39.2; 30/170; 81/45

(58) Field of Classification Search ..... 81/45; 299/37.1, 39.1, 39.2, 39.8; 30/170; 15/93.1; 52/749.12

See application file for complete search history.

(56) References Cited

U.S. PATENT DOCUMENTS 1,415,949 A 5/1922 Perelman
2,749,103 A 6/1956 Clemenzi
3,223,451 A 12/1965 Orr
3,740,099 A 6/1973 Lenzner
4,232,906 A 11/1980 Torbesson
4,269,450 A 5/1981 Welborn
4,366,991 A 1/1983 Hilshorst
4,477,989 A 10/1984 Vachon
4,673,219 A 6/1987 Perciful
5,205,103 A * 4/1993 Burton ..... 52/749.12
5,218,766 A 6/1993 Himebaugh
2004/0083679 A1 * 5/2004 Shinn et al. ..... 52/749.12

* cited by examiner

*Primary Examiner*—Sunil Singh
(74) *Attorney, Agent, or Firm*—Dowell & Dowell, PC

(57) ABSTRACT

A roofing material removal machine and method for removing roofing materials wherein the machine travels along guide rails mounted on a roof surface and roofing material lifting elements carried by the machine are operated to lift the roofing materials as the machine moves along the guide rails after which the removed materials are conveyed to a collection receptacle. A remote control device may be used to control power to and movement of the machine along the guide rails.

20 Claims, 8 Drawing Sheets

FIG. 3
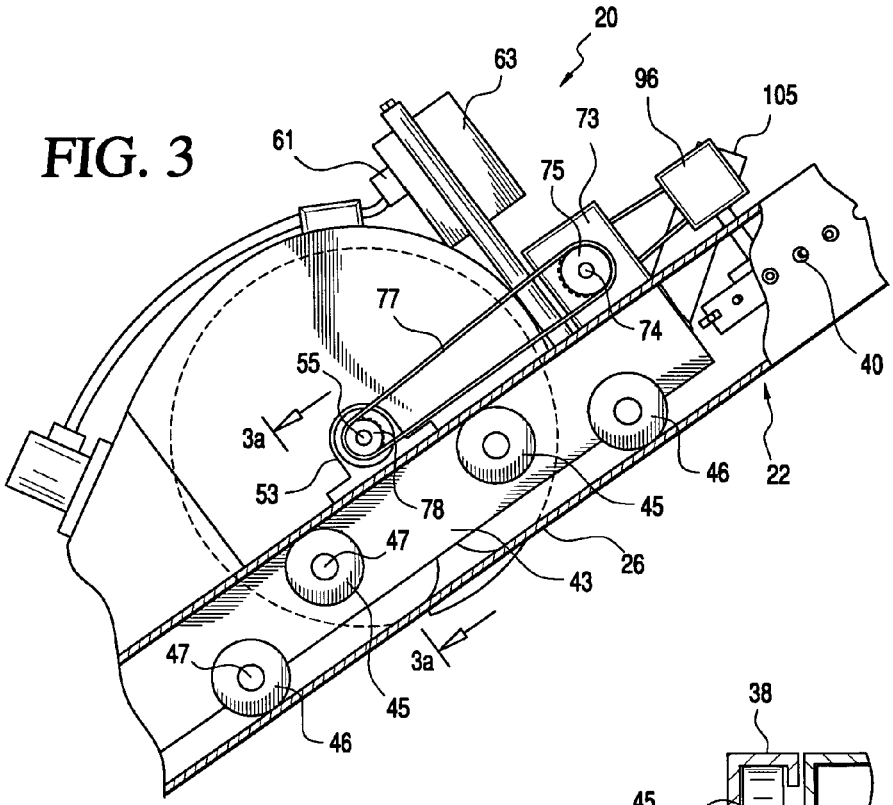
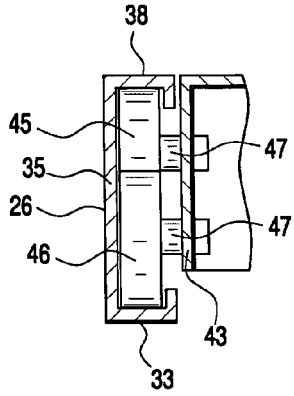
FIG. 3a
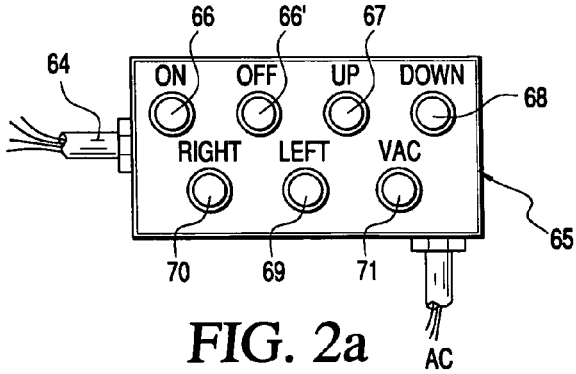
FIG. 2a

AUTOMATED ROOFING MATERIAL REMOVAL MACHINE AND METHOD

BACKGROUND OF THE INVENTION

1. Field of the Invention

The present invention is generally directed to machines for removing old roofing shingles, roofing felt, tar paper, nails and the like from building structures and more particularly to such a machine that is movably guided on guide rails that are mounted on a shingled roof. The machine includes a plurality of cutter heads that are mounted on a drive shaft driven by a power source carried by the machine. Drive elements mounted on the machine are also powered by the power source and move the machine relative to the guide rails. Removed shingles and other debris are thrown by the cutter heads to a discharge area of the machine housing from which they are pneumatically conveyed and/or conveyed by gravity to a collection receptacle or truck positioned adjacent the building from which the old roofing materials are being removed. The machine is preferably remotely controlled for operator safety.

2. Brief Description of the Related Art

Depending on the quality of roofing shingles, the pitch of a roof and ambient weather conditions, housing and other building shingles must normally be replaced every fifteen to thirty years. Often, two layers of shingles may have to be removed before new shingles may be installed. Hand tools for facilitating the removal of roofing shingles have long been known, however, such tools not only require a great deal of physical strength, but their use is labor intensive and often unsafe. Roofing, by its very nature, is a hazardous activity and, on steeply pitched roofs, it is extremely difficult for roofers to adequately and safely manipulate hand held shingle removal tools to remove old shingles and roofing nails or other fasteners.

To reduce the amount of manual labor needed to normally strip a roof of old shingles, nails and tar paper or other underlayment, various types of powered machinery have been design and developed to mechanically perform the work traditionally done by hand. Such powered shingle removing machines include electrical or gas fueled engines that are mounted on a frame supported by one or more sets of wheels. The engines provide sources of power to the wheels and/or cutters associated with the machines. The cutters may vary from movable chisel-like devices to cutting blades or rotary drum-like devices. Unfortunately, such machines are difficult to manipulate and often totally unsuitable for use on steeply pitched roofs. Also, manipulating any type of powered machinery on a roof is extremely dangerous and unsafe.

The removing of old roofing shingles or cedar shakes is a three Phase operation. The initial phase is the removal of the old roofing material by chipping or prying it up either manually, using a tool such as a spade or pry bar, or using a powered machine. Phase two is to then pull and remove the nails, tacks or other fasteners used to secure the old roofing materials. Phase three is the physical picking up of all the debris and depositing the debris in a waste receptacle.

Some examples of prior art powered shingle and other roofing material removing machines are disclosed in U.S. Pat. Nos. 5,218,766 to Himebaugh, 4,269,450 to Welborn, 4,673, 219 to Perciful, 4,232,906 to Torbenson, 3,740,099 to Lenzner, 3,223,451 to Orr, 2,749,103 to Clemenzi, and 1,415,949 to Perelman.

SUMMARY OF THE INVENTION

The present invention is directed to an automated shingle removing machine that overcomes the problems associated with the prior art roofing shingle removing machines and manually operated tools or implements and provides a safe and labor efficient manner of removing old roofing materials in order to prepare structures for new roofing shingles and other materials. The invention is directed to a machine that may be quickly placed into service on most roofs regardless of their pitch because the machine is not manipulated or physically guided by an individual during use. Rather, the shingle removing machine of the invention is mounted on a roof supported guide rail assembly and is movable along opposite rails of the assembly under its own power.

In the preferred embodiment the machine includes a primary frame mounted on four sets of oppositely oriented rollers or wheels that are designed to ride within opposing u-shaped guide rails or tracks of the guide rail assembly. The u-shaped guide rails are suspended from pivotally adjustable brackets or suspension members that engage an opposite side of a roof from where the guide rails are in use. There is a first set of roller on each side of the primary frame for engaging an upper surface of the guide rails and a second set on each side of the primary frame for engaging a lower surface of the guide rails. The u-shaped rails positively orient the machine as it moves along the rails under power provided by a driving device that may be an engine, motor or other suitable power source. In the preferred embodiment, the power source is an electric motor that is supported by the primary machine frame, however, hydraulic or pneumatic motors that receive liquid or air from a source that may be remotely spaced from a roof being work on may be used as well as petroleum or gas powered engines. The electric motor is preferably connected to a remote controller, either by way of a direct cord-like or cable connection or by a remote controller capable of sending high frequency or other signals to an on board motor controller. In this manner, the machine may be remotely operated from the ground during use, thereby reducing the risk of injury to the machine operator.

The machine includes a cutter bar that extends across a width of a lower opening in a cutter housing that is mounted on a secondary inner frame that is adjustably mounted on the primary frame and such that the cutter bar is adjustable relative to a roofing material lifting and conveying assembly that cooperates with the cutter bar head to lift roofing shingles, nails, felt, tar paper and the like, cut the materials and convey the materials to a discharge area of the housing. The roofing material lifting and conveying assembly is mounted within the housing and includes a plurality of uniquely configured hammers that are mounted in side-by-side relationship to a drive shaft supported by opposite bearings carried by the secondary frame.

Each hammer includes a base portion that is adjustably mounted to the drive shaft and which is integrally formed with an outer head by an integrally formed arm or shank. The hammers are mounted at different angular positions relative to the drive shaft so that the weight of the hammers is generally equally distributed about the drive shaft and such that two or more spaced sets of hammers cooperatively engage and lift roofing shingles at the same time and force the uplifted shingles, nails and other materials against the cutter bar and thereafter throw the cut and shattered pieces of roofing materials toward the collector.

The outer face of each of the hammer heads is convexly configured from a beveled leading edge such that the hammers, when rotating, will not cut into the roof structure but will only lift and pull the covering materials including the shingles, roofing felt, tar paper and nails upwardly and toward the cutter bar. In some embodiments, the shingle lifting and conveying assembly may be vertically adjustable so that the hammers may be selectively gauged to penetrate a predetermined distance relative to the roofing materials.

The shingle removing machine is moved relative to the guide rails by at least one pair of drive elements, which, in the preferred embodiment, are cog-like wheels having teeth or projections which engage or intermesh with racks formed in side walls of the guide rails. The cog-like wheels are simultaneously driven by secondary drive connections to the electric motor. The motor includes a twin disc brake or the secondary drive connections may include anti-back drive gears that provide positive braking force to prevent movement of the machine unless power is being positively provided to the drive elements from the motor. In this manner, if power to the motor is interrupted for any reason, the machine will automatically become locked in position to the guide rails. The electric motor can be reversely driven such that the machine is movable in a reciprocating manner along the guide rails.

The roofing material debris that is forced into the collector housing of the machine is pneumatically conveyed through a flexible conduit or pipe to a collection receptacle such as a dumpster or truck. In the preferred embodiment, a fan or pump is associated with the conduit to provide a positive force to convey the roofing material debris to the collection receptacle. In some embodiments, a pump or fan is mounted on or adjacent the machine to create a positive airflow through the housing and into the conduit connected to the collector and through which the debris will be conveyed by gravity to the collection receptacle.

In some embodiments, the guide rail assembly may include wheels, rotors or endless track devices, also powered by a motor, to automatically adjust the positioning of the guide rails relative to a roof. The guide rails are pivotally adjustable to a suspension frame that is designed to engage an opposite sloping surface of a roof relative to the guide rails such that the guide rails and the suspension frame are on opposite sides of a hip of a roof. An electric or other motor may be mounted on the suspension frame and drivingly connected to the drive wheels or endless track drive elements so that the guide rail assembly may be operative shifted laterally relative to a roof after the shingle removing machine has moved along a length of the guide rails to remove roofing materials along a first portion of a roof's surface.

It is a primary object of the present invention to provide a shingle removing machine which may be easily placed on a guide rail assembly that includes a pair of opposing guide rails that are suspended over a hip of a roof structure and thereafter controlled by an operator either on the roof or at a remote location, such as at ground level adjacent the structure being worked on, such that the machine is operable to remove old roofing shingles, nails, roofing felt, tar paper or the like without direct physical manipulation.

It is another object of the invention to provide a safe and expedient manner of removing old roofing materials wherein the materials are automatically conveyed to a collection receptacle as they are removed thus facilitating cleanup of a work site.

It is yet another object of the invention to provide a method of removing shingles and other roofing materials wherein a machine is positively guided relative to a roof and movable along guide rails, substantially regardless of a pitch of the roof, and wherein the roofing materials are stripped and collected generally simultaneously as the machine moves along the guide rails positioned on the roof.

It is also another object of the invention to provide a machine for removing old roofing materials wherein a size of material debris may be selectively controlled by adjusting a relative spacing of the cutter bar of the machine with respect to the roofing material removing hammers associated with the machine.

It is another object of a varied embodiment of the invention to provide a machine for removing old roofing materials and fasteners from a roof wherein the machine and a guide rail assembly on which the machine is positively guided and supported may be automatically shifted relative to a roof surface so that substantially an entire surface of a section of roof may be stripped without having to manually manipulate the machine or the supporting rail assembly.

BRIEF DESCRIPTION OF THE DRAWINGS

A better understanding of the invention will be had with reference to the accompanying drawings wherein:

FIG. 2*a* is a top plan view of a remote controller for using in controlling the roofing material removing machine and also showing optional switches for controlling movement of the guide rail assembly in an alternate embodiment of the invention;

FIG. 3 is a partial right side view showing a drive connection between a drive motor and a driven shaft of a roofing material lifting and conveying assembly mounted within a housing of the roofing material removal machine of the invention;

FIG. 3*a* is a partial cross sectional view taken along line 3*a*-3*a* of FIG. 3;

DESCRIPTION OF THE PREFERRED EMBODIMENTS

Figures 1, 7:
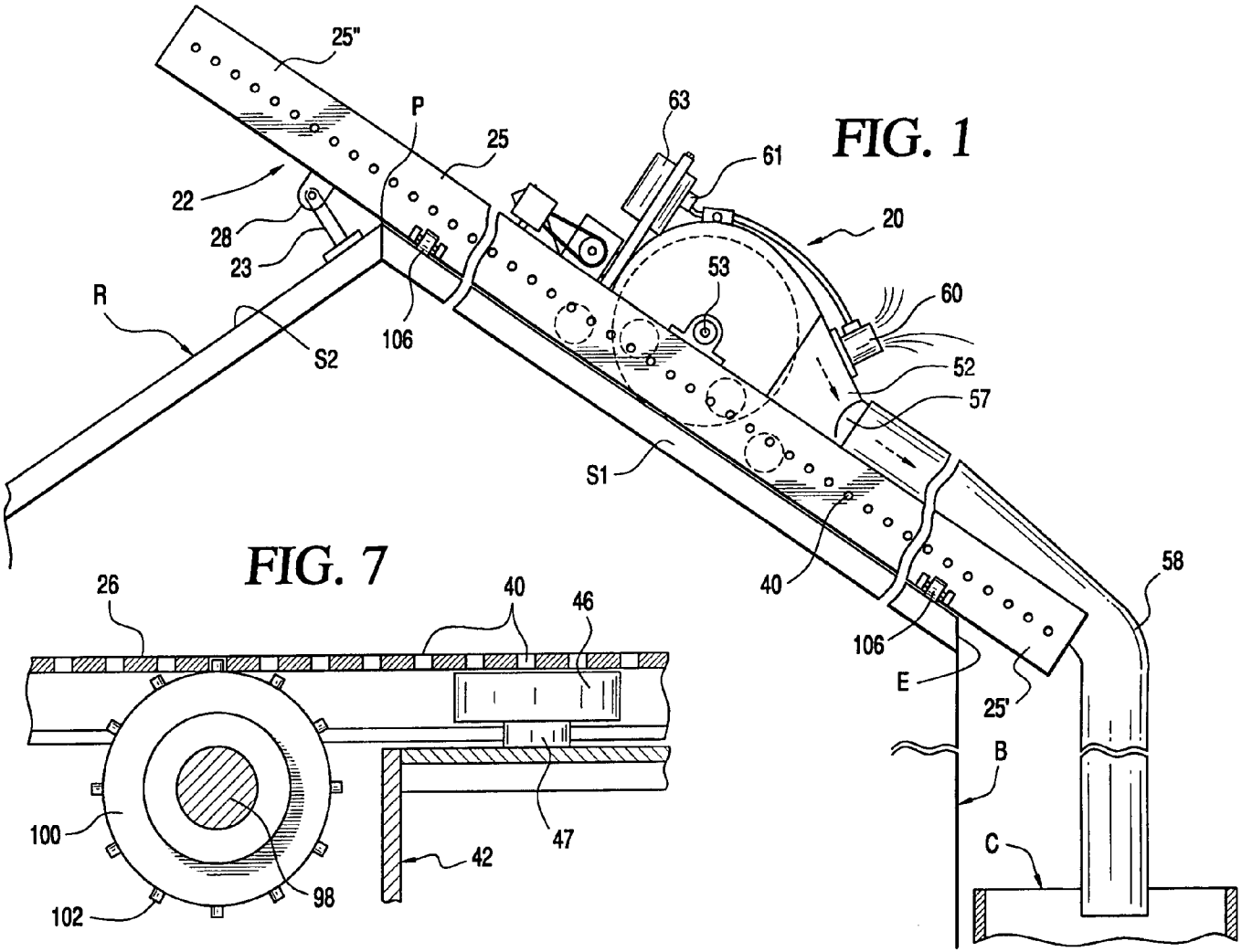
FIG. 1 is a side illustrational view of the roofing material removal machine and guide rail assembly of the invention showing the guide rail assembly mounted over a hip of a roof such that guide rails on which the machine is mounted extend downwardly on one side of the roof with the rails being anchored by a suspension frame positioned on an opposite side of the roof.
FIG. 7 is an enlarged partial cross sectional view taken along line 7-7 of FIG. 5 showing one of the driven cogwheels of the roofing material removal machine drivingly engaged with spaced openings in an adjacent guide rail.

With continued reference to the drawing figures, the invention will be described as being used to remove shingles, roofing felt, tar paper, fasteners and other roof covering materials "M" from a roof "R". The roof is shown as being a hip roof having oppositely pitched roof sections "S1" and "S2" that meet at the peak or ridge "P" of the roof. The invention can be used on substantially any roof regardless of the roof pitch and can be controlled remotely by an operator from a position of safety.

Figure 2:
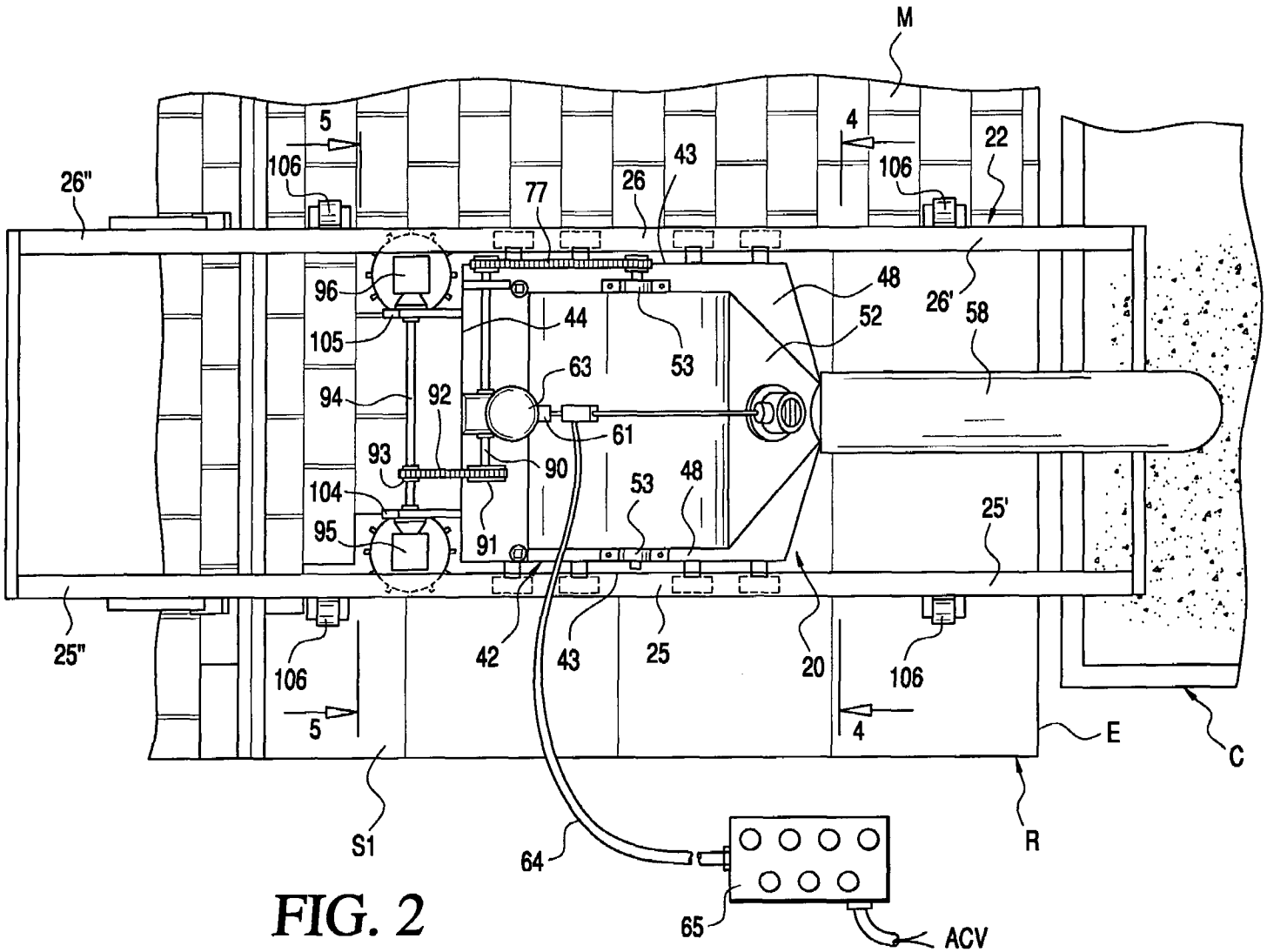
FIG. 2 is a top plan illustrational view of the roofing material removal machine and guide rail assembly mounted on a roof as shown in FIG. 1.

The invention includes a roofing material removal machine 20 that is guided and supported by a guide rail assembly 22 that, in the embodiments shown, includes a pair of suspension legs 23 from which a pair of guide rails or tracks 25 and 26 are suspended. As shown in FIGS. 1 and 2, the guide rails extend downwardly along roof section "S1" in spaced but parallel relationship with respect to one another. The lower portions 25' and 26' of the guide rails extend or are cantilevered outwardly relative to the lowest edge "E" of the roof whereas, the upper portions 25" and 26" extend upwardly beyond the ridge "P" of the roof for permitting the roofing material removal machine 20 to be effectively guided over the entire section "S1" of the roof.

The guide rails are pivotally adjustably connected at 28 to the suspension legs 23 so that an angle between them may be selectively adjusted to match with the pitch angle between the roof sections "S!" and "S2". Once the proper angle has been set, locking pins (not shown) are used to retain the suspension legs and the guide rails of the guide rail assembly in fixed relationship with respect to one another. The suspension legs 23 function like a bracket or hanger and support the weight of the guide rails and the roofing material removal machine. In some instances, additional anchors or fastening devices may be used to secure the suspension legs or guide rails to the roof section "S2". In another embodiment to be described in greater detail hereinafter, the suspension legs may be replaced with an adjustable frame on which a drive assembly is mounted for use in moving the guide rail assembly laterally with respect to a roof. The guide rails and the suspension legs are preferably formed of steel.

Figure 4:
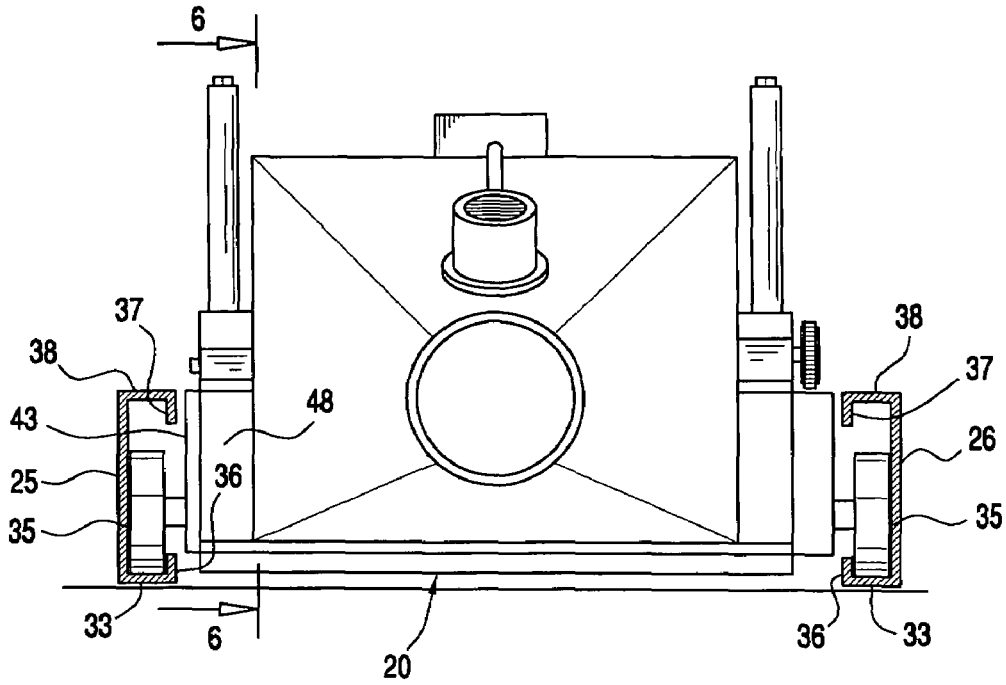
FIG. 4 is a rear elevational view taken along line 4-4 of FIG. 2 of the roofing material removal machine of the invention mounted within opposing guide rails of the guide rail assembly with the guide rails shown in section.
Figure 5:
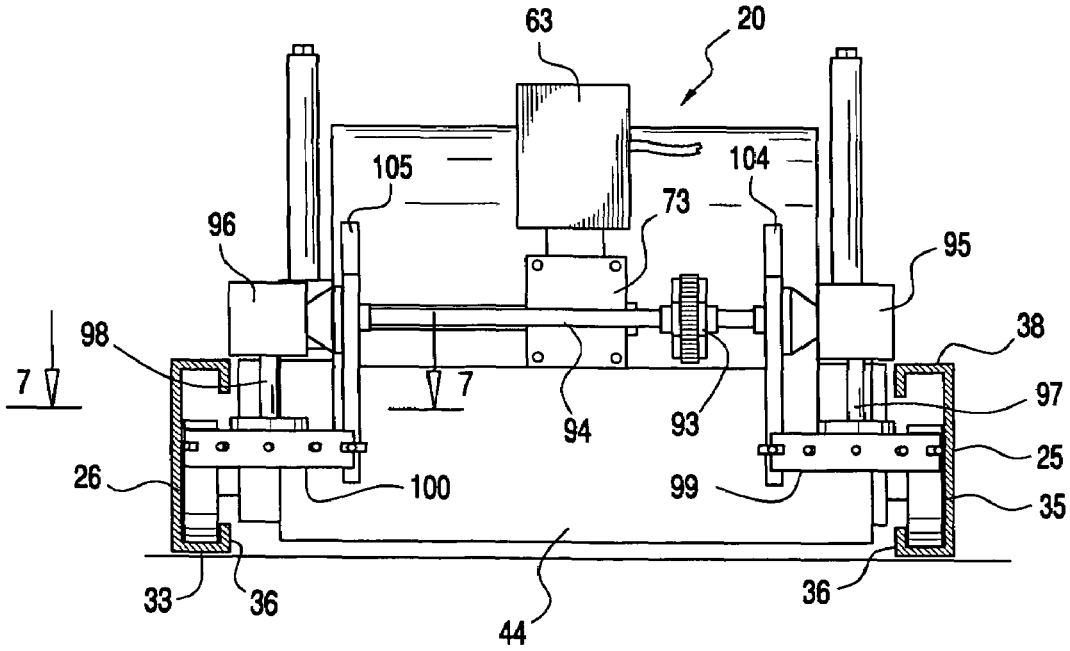
FIG. 5 is a front elevational view taken along line 5-5 of FIG. 2 of the roofing material removal machine showing a drive connection between the drive motor and a pair of driven cogwheels that intermesh with spaced openings provided in the guide rails.

As shown in FIGS. 4 and 5, the guide rails 25 and 26 are generally c-shaped in cross section and include lower walls 33 that are bounded by an outer wall 35 and inner lower flange 36. An upper flange 37 is aligned with the lower flange and extends from an upper wall 38 of each guide rail. The guide rails not only provide positive guidance for the roofing material removal machine, as will be described herein, but each rail is also provided with a plurality of generally equally spaced holes 40 that are made in the outer wall 35 for purposes of providing a rack-like surface that cooperates with driven elements on the roofing machine, as is shown in FIG. 7. As opposed to the holes 40, a linear gear-like rack could be used along an inner surface of the outer wall of each guide rail.

With reference to FIGS. 2, 3 and 3*a*, the roofing material removal machine 20 includes a generally rectangular steel frame 42 including opposite sidewalls 43 and end members 44. The frame is movably supported on upper and lower sets of wheels or rollers 45 and 46 that are mounted on each side wall and which are of a size to cooperatively track against the upper and lower walls 38 and 33, respectively, within the opposing guide rails 25 and 26, and between the flanges 36 and 37 and the outer walls thereof. The wheels are mounted on stub shafts 47 connected to the sidewalls 43 of the frame 42. As the wheels or rollers engage both the upper and lower portions of the guide rails, the machine is positively and securely contained within the rails regardless of a pitch angle of a roof on which the machine is operating.

Figure 6:
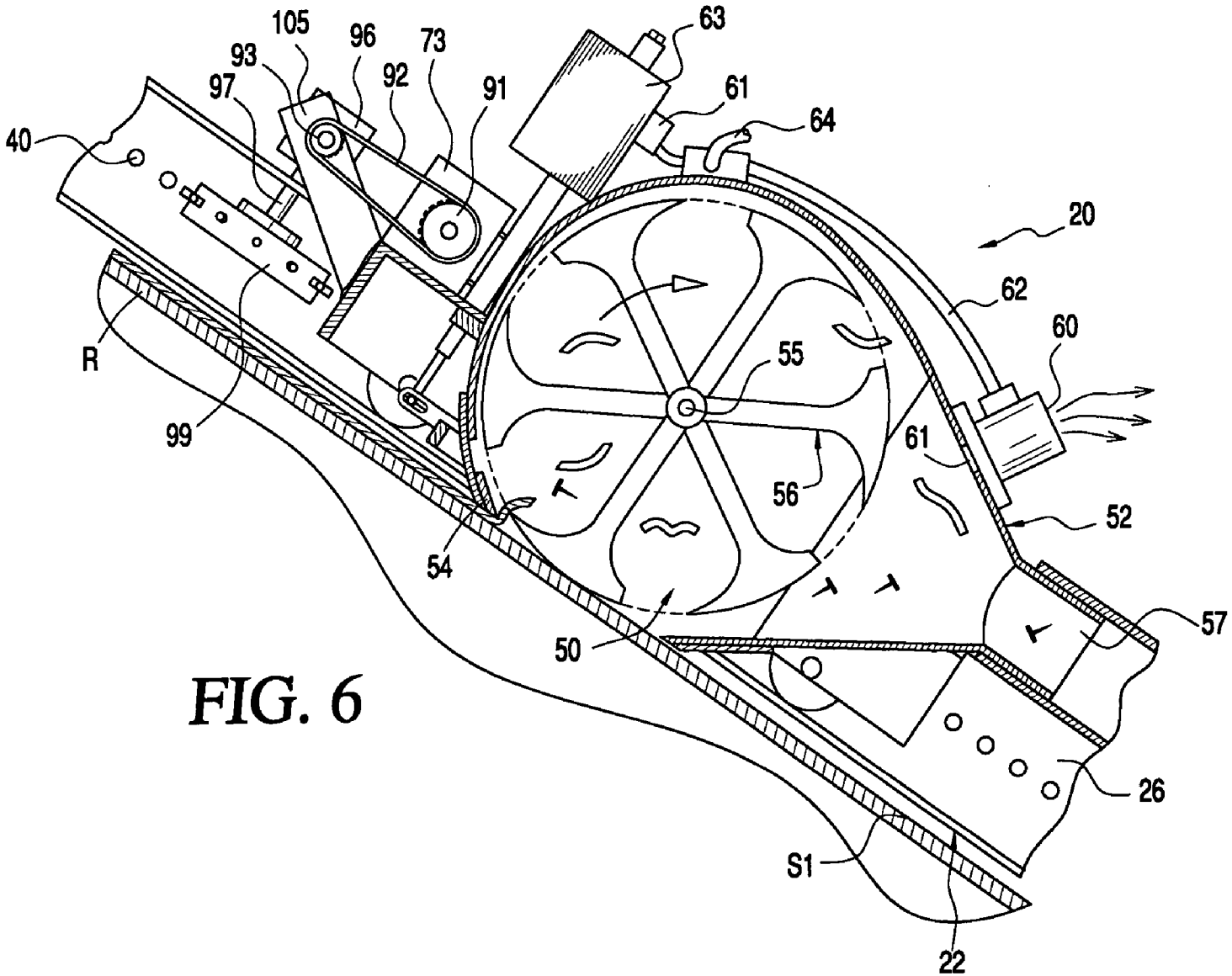
FIG. 6 is a cross sectional illustrational view taken through the roofing material removal machine showing the manner in which the old shingles, felt, paper and fasteners are lifted by cutting hammers that force the materials against a cutter bar and thereafter cast the shredded material into a discharge duct of the collector housing.
Figure 6A:
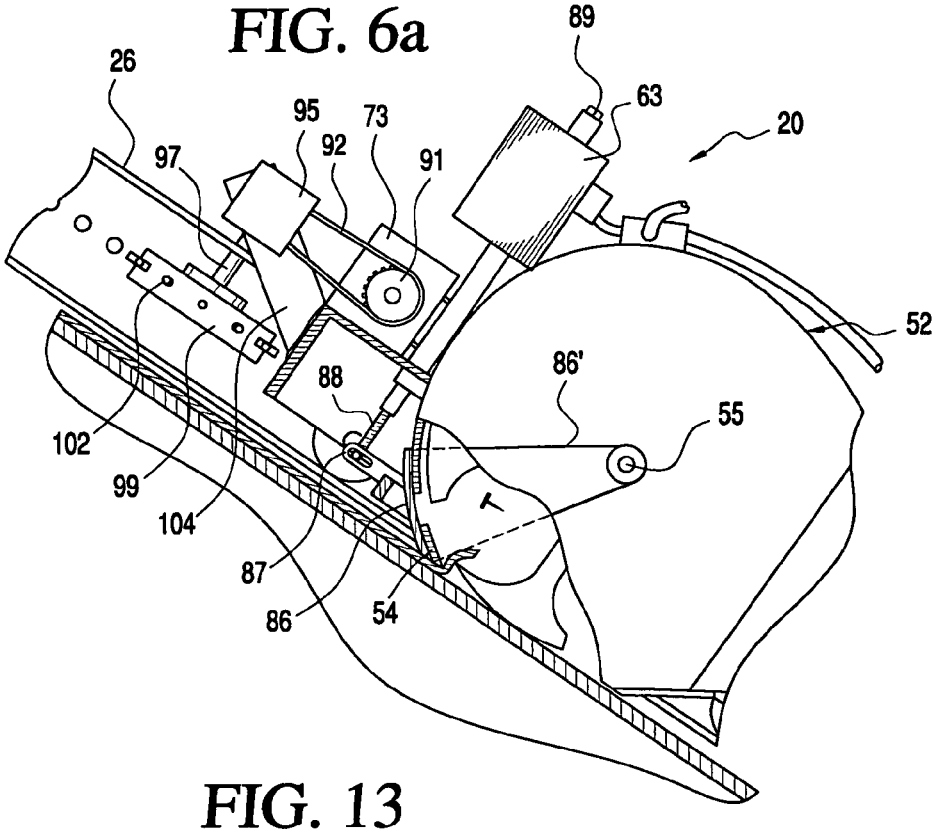
FIG. 6*a* is a view similar to FIG. 6 showing adjusting rods for adjusting a relative spacing between the cutter bar of the machine and the roofing material lifting hammers.
Figure 13:
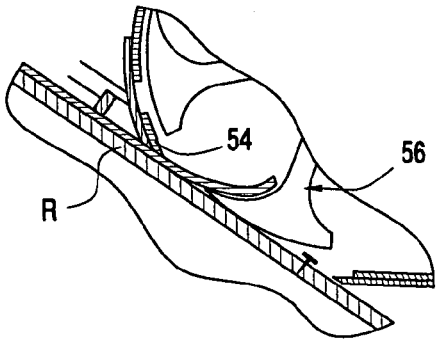
FIG. 13 is a close up view illustrating the manner in which one of the cutting hammers lifts roofing material toward the opposing cutting bar.
Figure 14:
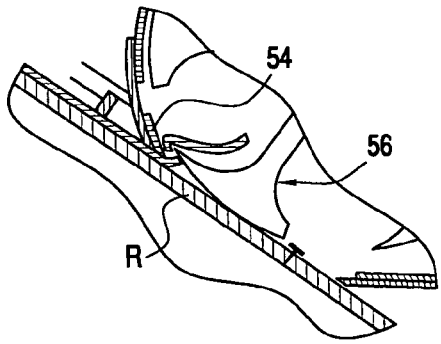
FIG. 14 is a view similar to FIG. 13 showing the roofing material being severed.
Figure 15:
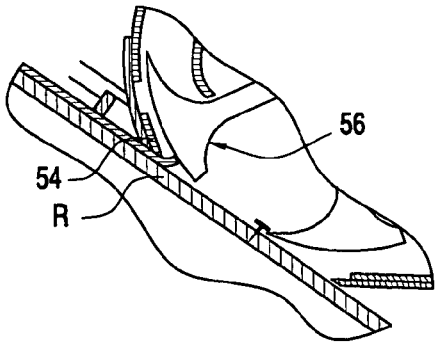
FIG. 15 is a view similar to FIG. 13 showing one of the hammers pulling out a roofing nail.

Mounted inwardly of the sidewalls 43 of the frame 42 is a secondary steel frame 48 that supports a cutting assembly 50 and material guide or collector housing 52. Two bearing assemblies 53 are mounted in aligned relationship with one another on opposite sides of the secondary frame and in which are rotationally supported opposite ends of a driven shaft 55 of the cutting assembly. The cutting assembly includes a plurality of cutting hammers 56 that are mounted on the shaft 55. The cutting assembly 50 is enclosed or covered within the material guide or collector housing 52 so that, as the cutting hammers are rotated to lift and remove roofing materials such as shingles, roofing felt, tar paper, nails and the like, the debris will be shattered into small pieces by a cutting bar 54 that is mounted forward of the hammers as shown in FIGS. 6 and 6*a*. The cutting action is illustrated in FIGS. 13-15. Thereafter, the debris is guided within the housing toward a rearward extending discharge duct 57, as shown in FIG. 6. A tube or pipe 58 is shown in FIG. 1 as being connected to the discharge duct 57 for conveying the debris toward a collection receptacle "C" that is positioned on the ground at the base of a building "B" on which the machine of the invention is in use. In this manner, the debris may be conveyed along the tube 58 by gravity from the discharge duct 57.

The debris may also be conveyed pneumatically into and along the tube 58. With reference to FIG. 6, a fan 60 is shown as being mounted at an opening 61 in the housing 52. The fan induces airflow from the cutting assembly toward the discharge duct 57 as shown by the arrows in the drawing. As opposed to using a fan mounted on the housing, a source of suction may be mounted along the tube 58 or adjacent the collection receptacle to facilitate movement of debris along the tube.

The fan 60 is electrically connected by conductor cord 62 to an electrical box 61 that is mounted adjacent an electric motor 63 that is mounted on a support bracket 64 that is welded or otherwise secured to the frame 42. The motor receives power from an elongated electrical control cord 64 that, in the preferred embodiment, extends to a controller 65, see FIGS. 2 and 2*a*, that is positioned remotely relative to the roofing material removal machine. It is preferred that the controller be used by an operator positioned on the ground thereby reducing the possibility of injury of an operator being positioned on the roof. Permitting the roofing material removal machine to be remotely operated not only reduces the risk of operator injury, but also reduces roofing expenses by lowering insurance costs associated with the roofing industry. The controller is designed to be connected to a source of AC power supply such as a power supply in a building or from a source such as a mobile electrical power generator.

As opposed to remotely controlling the roofing material removal machine by way of an electrical tether, a wireless control device may be used to supply radio frequency (RF) or other signals to a control unit mounted on the machine. The use of a non-tethered remote control device will reduce costs and simplify set up and operation of the roofing machine.

With specific reference to FIG. 2*a,* the controller 65 includes a number of operating buttons or switches for controlling power to the motor as well as for controlling movement of the roofing material removal machine as will described hereinafter. As shown, the controller includes an ON/OFF switches 66 and 66' for the motor 63 and directional switches 67, 68, 69 and 70 for controlling movement of the machine upwardly, downwardly and left or right, respectively, relative to the roof's surface. In addition, switch 71 is provided for controlling operation of the fan 60.

With reference to FIG. 3, the electric motor 63 has a drive output (not shown) that is connected through a transmission box 73 to a first drive shaft 74 on which is mounted a drive gear or sprocket 75. The drive sprocket 75 drives a chain 77 that is drivingly engaged to driven sprocket 78 mounted on one end of the cutting assembly driven shaft 55. When the operator engages the control switch 66 to an "ON" position, the first output drive shaft will receive power from the electric motor and thus initiate rotation of the hammers 56 mounted on the cutting assembly driven shaft 55.

Figure 8:
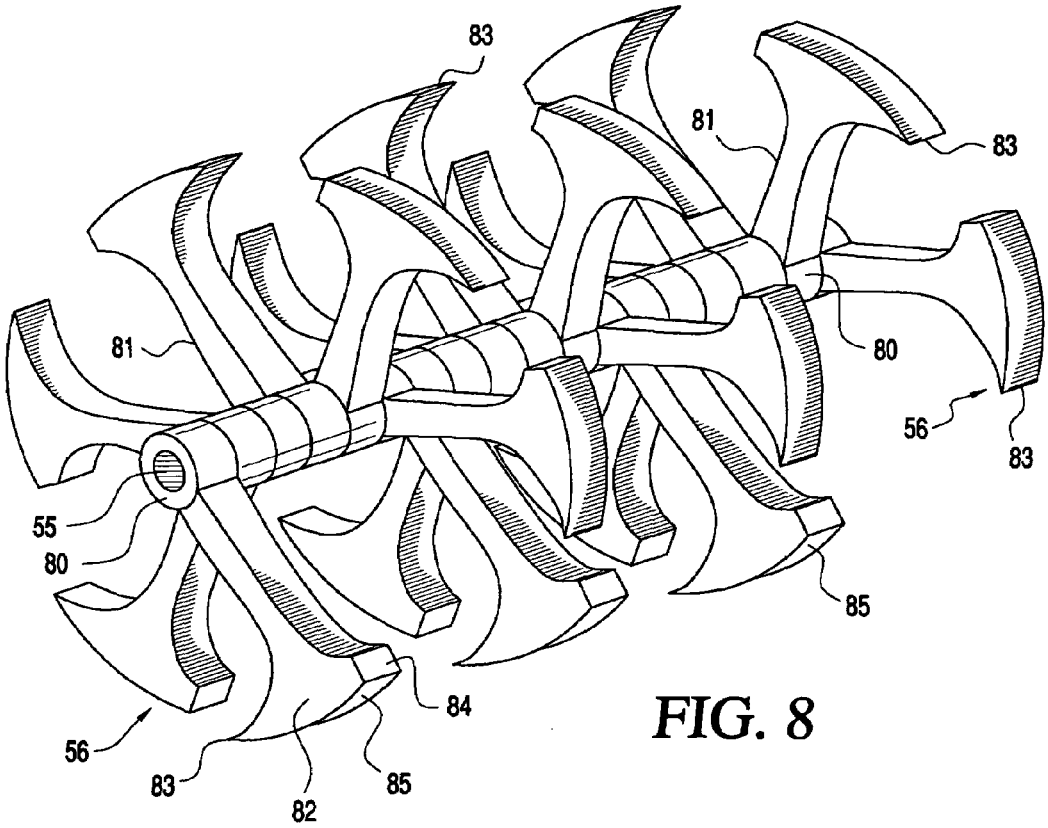
FIG. 8 is an enlarge perspective view of the cutting hammer assembly of the invention.
Figure 9:
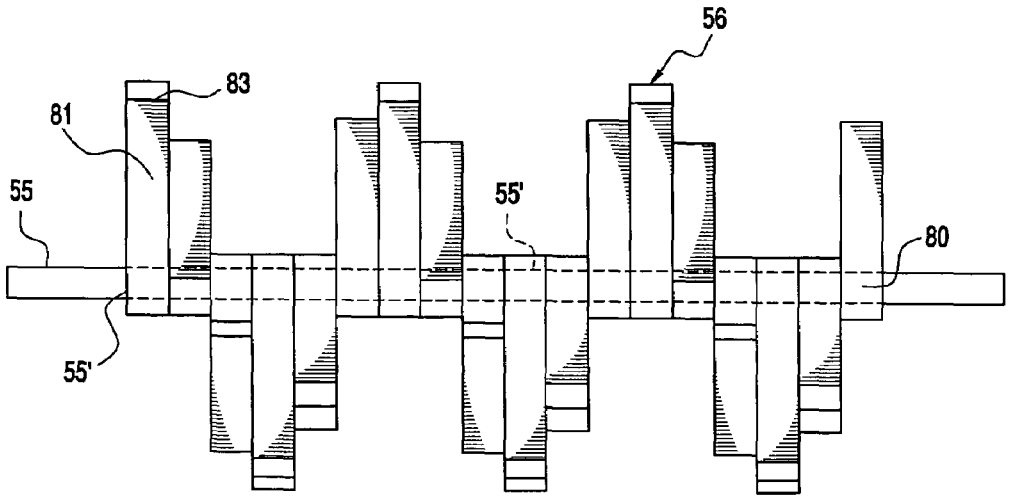
FIG. 9 is s front plan view of the cutting hammer assembly shown in FIG. 8.

The hammers 56 are more specifically shown in FIGS. 8 and 9. A central portion 55' of the cutting assembly driven shaft 55 is generally hexagonal in cross section so that cooperating hexagonal openings in the base 80 of each hammer permit the hammers to be slidably mounted to the driven shaft and yet are securely and fixedly mounted to rotate with the shaft. Each hammer includes a shank 81 extending from the base 80 and which terminates at an outer head 82. The head is preferably integrally formed with the shank and includes a forward oriented beveled lifting edge 83 and a rearward extending portion 84 that is provided to give extra mass to the head. An outer surface 85 of each head is generally convex in configuration so that the beveled lifting edge 83 curves slightly upwardly relative to a roof's surface when the lifting edge is in its closest proximity to the roof's surface during rotation of the cutting assembly driven shaft 55.

The uniquely curved configuration of each hammer allows the lifting edges to pass through and beneath the shingles, felt, and tar paper and lift these materials and subsequently drive or force these materials against the forward mounted cutting bar 54. Essentially, and as illustrated in FIGS. 6 and 13-15, the hammers primarily lift the roofing material from the roof and force the roofing materials against the cutting bar where the materials are cut and shattered into small pieces that are subsequently conveyed by the hammers and any pneumatic energy applied, to the exhaust duct of the collector housing. The configuration of the lifting edge of each hammer also lifts and extracts nails and other fasteners that are also conveyed to the exhaust duct. The illustrational views of FIGS. 13-15 are from the left side of the machine and show the hammers rotating counterclockwise toward the roofing materials as the machine is moved upwardly from a lower area of the roof toward an upper area.

As shown in FIGS. 8 and 9, the hammers are uniformly mounted on the driven shaft 55 so that the weight of the hammers is equally distributed about the shaft. The equal distribution of weight will reduce machine vibration as the hammers are driven in rotation. In the present embodiment, the hammers are positioned in sets of five such that the hammers of each set are disposed at approximately 72° relative to one another. In this manner, the lifting edge 83 of every fifth hammer will be aligned with one another so as to simultaneously engage an area of roofing materials. This arrangement will further facilitate the lifting and conveying of strips of materials, such as shingles, by the rotating hammers. Other arrangements and spacing may be used provided that the weight of the hammers is equally distributed about the driven shaft and, preferably, such that at least two spaced lifting edges simultaneously engage the roofing materials.

As previously described, the hammers 56 throw the uplifted roofing materials against the cutter bar 54, as is illustrated in FIG. 6. The spacing between the cutting bar and the hammers may be adjusted to thereby change the size of the materials being conveyed toward the exhaust duct. In this respect, and with reference to FIG. 6*a,* cutting bar 54 is secured on an adjustable housing section 86 that is connected to a pair of adjustment blocks 87 mounted above opposite sides of the secondary frame. The blocks have threaded openings there through for receiving adjustment rods 88. The top of each rod is keyed as shown at 89 to receive a removable crank or handle, not shown, to facilitate rotation of the rods. Upon rotation of the rods the blocks are raised or lowered thereby raising and/or lowering the cutting bar 54 relative to the hammers 56 by pivoting the adjustable housing section about the driven shaft 55. The adjustable housing section includes sides 86' that are freely pivotally supported adjacent outer ends of the driven shaft 55, as shown.

Movement of the roofing material removal machine 20 along the guide rails 25 and 26 is controlled using the switches 67 and 68 of the controller 65. The motor 63 provides power through the transmission box 73 to a secondary drive shaft 90, see FIG. 2, that has a sprocket 91 mounted thereto. The sprocket 91 drives a secondary drive chain 92 that supplies power through another sprocket 93 to a power splitter drive shaft 94. The power splitter drive shaft 94 is connected at its opposite ends to gear boxes 95 and 96. Power from the power splitter drive shaft is transferred in the gear boxes 95 and 96 to a pair of driven stub shafts 97 and 98 to thereby rotate a pair of guide rail engaging cogwheels 99 and 100.

As shown in FIGS. 5 and 7, the cogwheels 99 and 100 include a plurality of equally spaced projections or pins 102 that are configured to be cooperatively received within the spaced openings or holes 40 in the guide rails. When power is applied from the motor 63 and transmission 73 to the second drive shaft 90, the cogwheels will rotate in opposite directions thus engaging the pins 102 in successive openings 40 and thereby pulling the machine along the guide rails. The direction of movement depends on the direction of rotation of the second drive shaft as it receives power through the transmission box. Thus, in the embodiment shown in the drawings, when switch 67 of the controller is "ON", the machine will travel upwardly relative to the roof whereas, when switch 68 is "ON", the machine will travel downwardly along the guide rails.

As shown in the drawings, the gear boxes 95 and 96 and thus the cogwheels 99 and 100 are cantilevered forwardly of the machine primary frame 42. The gear boxes are mounted on a pair of forwardly extending mounting brackets 104 and 105 that are welded or otherwise secured to the front or forward end wall the primary frame, see FIGS. 2, 5, 6 and 6*a*.

To ensure that the machine cannot accidently move or travel along the guide rails when the motor 63 is not activated, either anti-backdrive gears are provide in the transmission box 73 or the motor is one that includes internal brakes, such as the twin disk brake system of Dayton® electric motors. The transmission preferably includes a neutral setting such that the cogwheels may freely rotate to facilitate the initial mounting of the machine in the guide rails such that the pins 102 are appropriately aligned with the holes 40.

In some embodiments, in order to facilitate lateral movement and positioning of the guide rail assembly, two or more wheel or roller units 106 may be attached in spaced relationship to the guide rails 25 and 26, as shown in FIGS. 1 and 2. The roller units will support the rails slightly above the roofing materials so that the guide rail assembly may be rolled laterally relative to the roof into a desired position. The rollers may be deployable such that they may be raised to rest the guide rails of the roof when the machine 20 is in use.

In the operation of the roofing material removal machine 20, the guide rails assembly is initially raised, preferably by a hoist or crane, and placed on a section of roof with the pivotally adjustable suspension legs or brackets 23 engaging an opposite sloping surface of the roof from where the guide rails are to be secured. After a proper angle has been established between the guide rails and the legs, the locking pins are used to rigidly secure the components together. Thereafter, the machine is raised using the same hoist or crane and aligned such that the supporting wheels or rollers of the machine track within the opposing guide rails. As the machine 20 is being placed in alignment with the guide rails, the cogwheels 99 and 100 will free wheel slightly in order to align with and seat within the holes 40 in the guide rails. As previously described, the motor preferably includes an interior braking system to prevent any movement of the machine relative to the guide rails whenever no power is supplied to the motor.

Once installed, the motor 63 is remotely controlled from an operator positioned in a safe area. The motor "ON" switch is engaged which initiates rotation of the hammers 56. The machine is controlled to move along the guide rails to the lowest point of the roof. Thereafter, the controller switch 67 is activated to cause the cogwheels 99 and 100 to drive the machine upwardly relative to the roof during which time the hammers will lift the old roofing materials and throw them against the cutter bar 42 to reduce them to small pieces that are conveyed by the rotating hammers and the pneumatic action created by the fan 60 being "ON" to the exhaust duct of the collector housing. The debris then is conveyed through the conduit 58 to the collection receptacle. After the machine travels to the uppermost end 25" and 26*a*" of the guide rails, the operator will reverse the direction of movement of the machine so that the machine moves to the lowest point along the guide rails. Thereafter, the motor is stopped and the entire guide rail assembly is shifted laterally of the roof so that the next area of the roof may be stripped and cleaned.

From the foregoing, not only is the roofing material removal machine of the invention safe to operate, as there is no manual maneuvering of the machine as the roofing materials are being stripped, but the machine also conveys all the debris directly to a collection receptacle.

Figure 10:
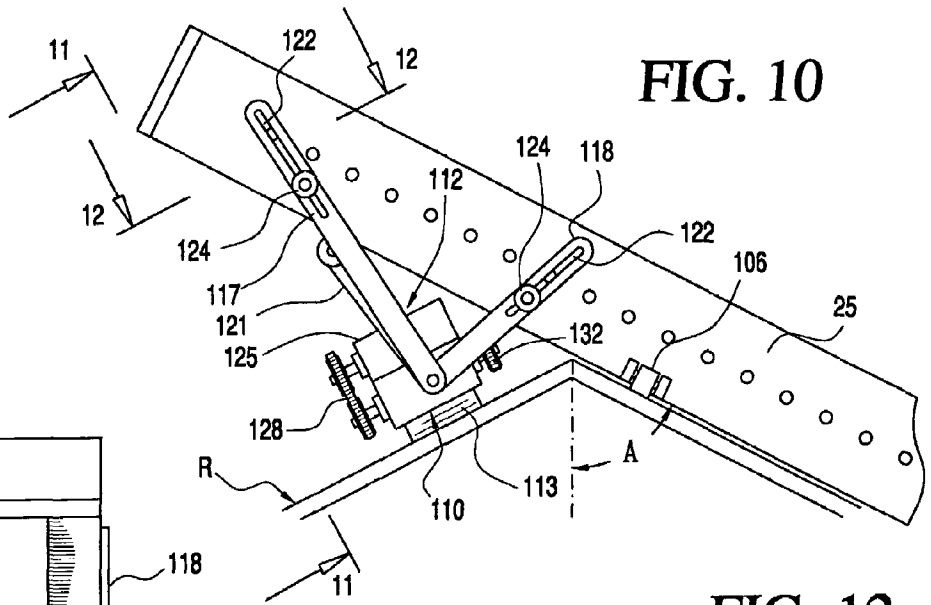
FIG. 10 is a partial right side view of another embodiment of the invention showing a modified suspension frame including a traction unit that can be remotely controlled for moving the guide rail assembly and the roofing material removal machine laterally relative to a roof.
Figure 12:
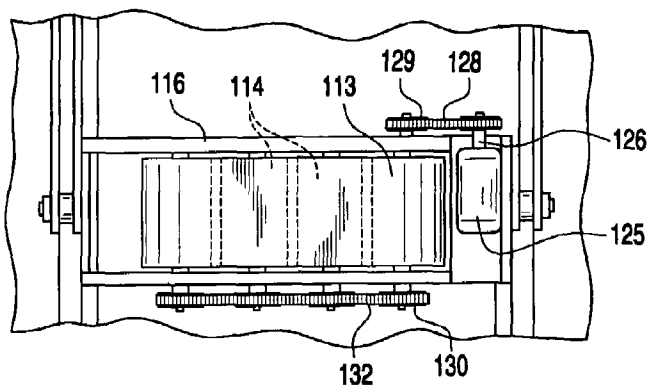
FIG. 12 is a view taken along line 12-12 of FIG. 10.
Figure 11:
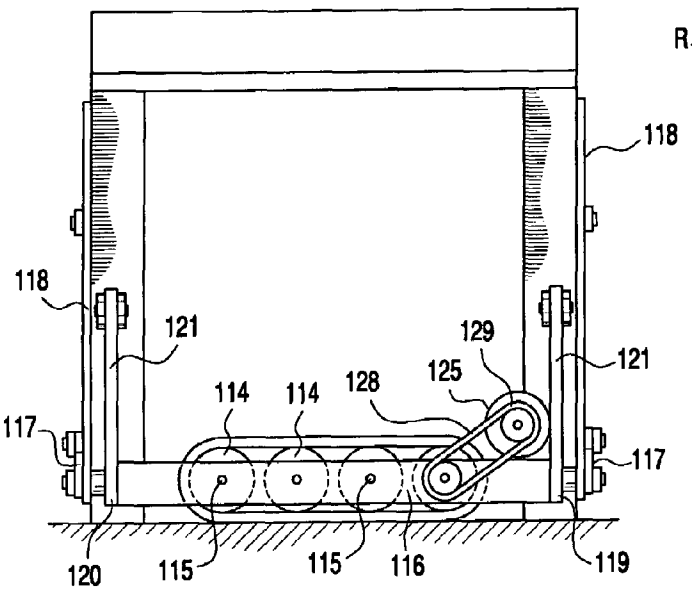
FIG. 11 is a view taken along line 11-11 of FIG. 10.

In a further embodiment of the invention and as shown in FIGS. 10-12, the guide rail assembly may be modified so that the assembly, with the machine mounted thereon, may be automatically shifted or moved laterally relative to a roof. In this manner, physical movement of the machine is only necessary to move the machine from one section of a roof to another. In this embodiment, the guide rails 25 and 26 are the same as previously described with the addition of the spaced rollers 106 for facilitating lateral repositioning of the guide rails relative to the roof.

The suspension brackets of the guide rail assembly, however, have been changed such that the legs have been replaced with a traction device 110 that is mounted on an adjustable bracket assembly 112 that is connected to the guide rails. Although the type of traction device may vary, as shown, it may include an endless drive belt 113 that engages the roof and is disposed about a plurality of driven rollers 114 fixedly mounted on shafts 115 carried by a suspension frame 116 that is pivotally adjustably connected at it's opposite ends to upper and lower arms 117 and 118 of the bracket assembly 112 as shown at 119 and 120. Also mounted to the opposite ends of the suspension frame 116 are guide rail engaging support arms 121 that transfer the weight of the guide rails to the traction device to thereby assist in suspending the guide rails from the roof as previously described.

Each of the upper and lower arms 117 and 118 of the bracket assembly 112 are adjustable relative to the guide rails so that the traction device is placed at a proper angle relative to the guide rails depending on the pitch or slope of the roof. The arms include open slots 122 and fasteners 124 for locking the arms in a fixed relationship relative to the guide rails after the correct mounting angle "A" has been achieved.

An electric or other motor 125, that is preferably remotely controlled by the controller 65 shown if FIG. 2*a*, is carried by the suspension frame 116 and includes a drive shaft 126 drivingly engaging a drive chain 128 that drives an input gear or sprocket 129 fixedly mounted on one end of an adjacent roller supporting shaft 115. An opposite end of the adjacent roller supporting shaft has another sprocket 130 mounted thereon, which gear provides power to the remaining support shafts 115 by way of a chain 132 that connects the sprocket 130 with similar gears mounted to each of the other support shafts.

As previously described, the controller may include switches 69 and 70 for providing power to the motor 125 and controls for causing the traction device to move laterally in opposite directions relative to a roof. As the guide rails are supported on the roller 106, the entire guide rail assembly can be remotely controlled to move laterally relative to a roof as is necessary when stripping the roofing materials from a section of roof. The operation of the invention is otherwise as previously described.

The foregoing description of the preferred embodiments of the invention has been presented to illustrate the principles of the invention and not to limit the invention to the particular embodiments illustrated and described. It is intended that the scope of the invention be defined by the following claims and their equivalents.

I claim:

1. An apparatus for removing roofing materials from a surface of a roof comprising; a guide rail assembly including a pair of spaced and opposing guide rails, means for anchoring the guide rail assembly relative to a surface of a roof, a roofing material removal machine mounted to said opposing guide rails, said machine including a first power source and a cutter assembly, said cutter assembly including at least one cutter element mounted to a rotary driven shaft, means for drivingly connecting said first power source to said rotary driven shaft, a cutter member mounted adjacent said at least one cutter element for cutting roofing materials lifted by said at least one cutter element, said cutter assembly being mounted within a housing of said machine such that roofing materials lifted and severed by the at least one cutter element and cutter member are guided within said housing to a discharge outlet therefrom, said machine further including first drive means powered by said first power source for moving said machine along said guide rails, and control means remote from said machine for controlling said power source and said drive means whereby said machine is guided by said guide rails relative the roofing materials to be removed and said machine is controlled without direct physical force applied thereto by an operator.

2. The apparatus of claim 1 wherein said means for anchoring includes bracket members pivotally adjustable relative to said guide rails for suspending said guide rails from a portion of a roof that is oppositely sloped from the surface of the roof on which the guide rail assembly is to be mounted.

3. The apparatus of claim 2 in which said bracket members are connected to a traction means for moving said guide rail assembly laterally relative to the surface of a roof, and second drive means for driving said traction means.

4. The apparatus of claim 3 wherein said second drive means for driving said traction means includes a second power source mounted on said means for anchoring, and said control means including means for controlling said second power source.

5. The apparatus of claim 4 including roller means mounted to said guide rails for movable supporting said guide rails on the surface of a roof.

6. The apparatus of claim 1 including conveying guide means extending from said discharge outlet to a collection receptacle.

7. The apparatus of claim 1 wherein said guide rails are generally c-shape in cross section, and said machine including a plurality of roller means engageable within said guide rails.

8. The apparatus of claim 7 wherein said roller means include a plurality of upper rollers and a plurality of lower rollers mounted to opposite sides of said machine, said upper rollers being engageable with upper walls of said guide rails and said lower rollers being engageable with lower walls of said guide rails.

9. The apparatus of claim 1 including means for adjusting a spacing between said cutter member and said at least one cutter element.

10. The apparatus of claim 1 including means for pneumatically conveying roofing material debris from said housing.

11. The apparatus of claim 10 in which said means for pneumatically conveying includes a fan mounted to said housing for urging debris toward said discharge outlet.

12. The apparatus of claim 1 in which said first drive means includes a pair of rotary members driven by said first power source, said rotary members including projections extending therefrom for intermeshing with portions of said guide rails.

13. The apparatus of claim 12 wherein each of said rotary members is a cogwheel having said projections extending therefrom and which projections are engageable in spaced holes in said guide rails.

14. The apparatus of claim 1 wherein said control means is connected to said machine by an elongated power cord.

15. The apparatus of claim 1 wherein said at least one cutter element includes a plurality of hammers with each hammer having a base, a shank and an outer head having a convexly curved outer surface and a tapered forward lifting edge, said base of each hammer being mounted to said rotary driven shaft, and said plurality of hammers being mounted to said rotary driven shaft such that the combined weight thereof is uniformly distributed about said rotary driven shaft.

16. The apparatus of claim 15 wherein said plurality of hammers are oriented relative to said rotary driven shaft such that said lift edges of at least two of said plurality of hammers are aligned with one another such that, during use, the aligned lifting edges simultaneously engage roofing materials being removed from a roof.

17. A method of removing shingles and other roofing materials from a surface of a roof using a powered machine that is mounted to travel along guide rails and wherein the machine includes means for lifting the roofing materials from the surface of the roof that is powered by at least one power source mounted on the machine and means for moving the machine along the guide rails, the method comprising the steps of:

A. placing the guide rails on a surface of a roof;

B. placing the machine on the guide rails such that the machine is positively guided to travel along the guide rails;

C. providing a remote control device for controlling the at least one power source and the means for moving; and D. lifting the roofing materials from the surface of the roof by using the remote control device to control the at least one power source to power the means for lifting the roofing materials and forcing the roofing materials against a cutter member to cut the roofing materials into smaller pieces and controlling travel of the machine along the guide rails using the remote control device to control the means for moving without an operator of the control device physically maneuvering the machine.

18. The method of claim 17 including an additional step of suspending the guide rails from a suspension means that is disposed on an opposite side of a ridge of the roof from the position of the guide rails and such that the guide rails are oriented upwardly from adjacent an edge of the roof to adjacent the ridge.

19. The method of claim 18 including providing means for moving the guide rails on the suspension means and using the remote control device to control the means for moving the guide rails to move the guide rails laterally along the surface of the roof.

20. The method of claim 17 including the additional step of continuously conveying the roofing material lifted and cut by the means for lifting the roofing material and the cutter member from the machine to a remote collection receptacle as the machine travels along the guide rails.

* * * * *